United States Patent [19]

Brueggeman

[11] 4,267,414

[45] May 12, 1981

[54] FOOT CONTROL FOR SNOW PLOWS

[75] Inventor: Michael B. Brueggeman, 63 Chestnut St., Painesville, Ohio 44077

[73] Assignees: Michael B. Brueggeman; Henry C. Brueggeman, both of Eastlake, Ohio

[21] Appl. No.: 63,147

[22] Filed: Aug. 2, 1979

[51] Int. Cl.[3] ..... H01H 21/26

[52] U.S. Cl. ..... 200/86.5; 200/153 C; 74/478; 74/514

[58] Field of Search ..... 200/153 C, 86.5, 18, 200/340, 159 R, 159 B, 50 C; 74/474, 478, 478.5, 512, 513, 514

[56] References Cited

U.S. PATENT DOCUMENTS

| | | | |
|---|---|---|---|
| 497,144 | 5/1893 | Teal | 200/86.5 |
| 3,399,287 | 8/1968 | Euler | 200/159 R |
| 3,743,807 | 7/1973 | Miller | 200/159 R |
| 3,982,081 | 9/1976 | Demler, Jr. | 200/159 B |
| 4,142,080 | 2/1979 | Takahashi | 200/86.5 |

FOREIGN PATENT DOCUMENTS

| | | | |
|---|---|---|---|
| 558611 | 1/1975 | Switzerland | 200/86.5 |

*Primary Examiner*—Gerald P. Tolin
*Attorney, Agent, or Firm*—Frank B. Robb

[57] ABSTRACT

There is disclosed foot control construction for use in the control of snow plow positioning mechanism, particularly mechanism which is used to control angular and vertical movement of the blade thereof, said control comprising a body having a generally rectangular upwardly disposed face, said face being angularly disposed to provide for foot support, control switches for effecting blade movement being arranged generally near the corners of the face, to be operable one at a time by the heel or toe, a suitable arch support element intermediate the switches requiring pivotal action of the foot of an operator to actuate a switch, and a reference member extends from the element to prevent operation of more than one toe or one heel switch at a time.

5 Claims, 3 Drawing Figures

FOOT CONTROL FOR SNOW PLOWS

BACKGROUND AND GENERAL DESCRIPTION OF THE INVENTION

The control of snow plows which are attached to the front of a vehicle, is most often effected by switches mounted for hand actuation, usually on or near the steering column of such vehicle, to facilitate observation by the operator of the position of the control member, because of the necessity to definitely ascertain what movement should be effected, in causing the blade to be disposed upwardly and downwardly and pivotally from side to side, being effected by electric switches which in turn start and stop hydraulic means to carry out the actions noted.

It is desirable to prevent more than one movement at a time and thus complicated switch gear has been used. It is obviously desirable to simplify such gear if possible and even more desirable to enable the operator of the vehicle to maintain control thereof, which may often require use of both hands to steer and thus limit undesired direction of movement. Further it is often necessary to change the blade attitude while steering direction is changing and thus both hands are occupied.

It is a principal object of this invention to facilitate change in plow attitude without requiring hand manipulation of a control member and to that end the foot control hereof is provided which will enable movement of the blade by a foot control unit and because of the arrangement and construction facilitate individual movements to be carried out under switch control using the foot and without necessity to observe the foot position, although four separate positions of the foot are required.

More particularly the control hereof is arranged to support the foot of the operator in a comfortable position, enable the operation of toe and heel switches for entirely separate and distinct up and down movement of the blade and by repositioning the foot effect pivotal movement of the blade availing of a reference element to assist the operator to correctly locate the switches for such movement entirely by feel even though he is wearing heavy footwear somewhat limited in sensitivity thereby.

Other objects and details of construction of the invention will be understood from the description set forth hereinafter and disclosed in the drawing wherein:

FIG. 3 is a diagrammatic disclosure of a suitable circuit for effecting and connecting the various parts to effect operation of a snow plow or the like.

DETAILED DESCRIPTION OF THE INVENTION

Figure 1:
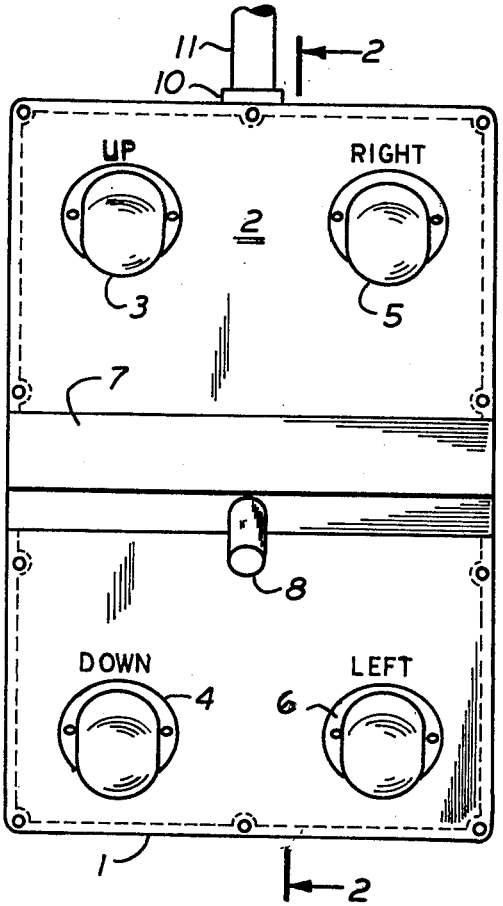
FIG. 1 is a top plan view of the control hereof.
Figure 2:
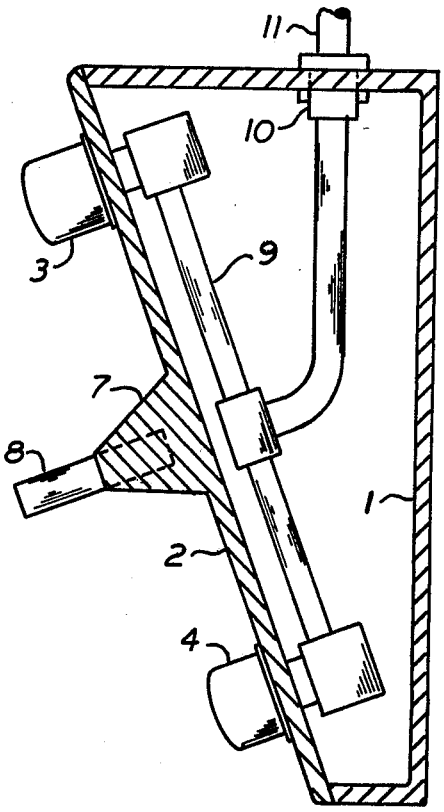
FIG. 2 is a sectional view in side elevation showing some of the details of construction of such control.

Referring now to FIGS. 1 and 2 hereof, the control of this invention is embodied in a body designated 1 which is a hollow member preferably formed in any suitable manner as of plastics or the like, which body is provided with a flat upper surface 2 angularly positioned with regard to the body for reasons which will become apparent.

Mounted on this upper surface member which is angularly positioned and designated 2, are four toe operating means including push button switches arranged in sets to comprise a first set of operating means including the toe operating means 3 and the heel operating means 4 which in this instance are provided to operate the raising and lowering of a snow plow for example.

Spaced adjacent those first operating means and designated a second set of operating means are the switches 5 and 6 to control the pivotal action of a snow plow or the like the switch 5 being availed of to pivot the plow to the right and the switch 6 to pivot the plow to the left.

Intermediate the switches 3 and 4 and 5 and 6, is an arch support element 7 which as clearly shown in FIG. 2, extends upwardly a substantial distance above the surface 2 of the body 1.

This arch support element 7 is arranged so that it will support the foot of an operator and by pivotal action of the foot fore and aft so to speak the toe of the operator may engage a switch 3 for example and by oppositely pivoting the foot engage a switch 4 to effect the respective up and down operation of the snow plow blade for example.

The switches 3 to 6 inclusive are preferably arranged so as to be sealed and have flexible coverings thereover to prevent the entry of water and snow into the interior of the body 1, the switches being of generally known construction and not forming a part of this invention other than to provide the necessary combination action which is described.

Arranged about centrally with respect to the side to side formation of the arch support element 7, is a reference member 8 in the form of a post which extends upwardly above the highest point of the arch support member 7, and in effect divides the upper area of the surface member 2 into halves so that when the toe and heel are to operate the switches 3 and 4 the foot may be placed against the reference member, or more clearly, the outer part of the foot may be placed against the reference member, and when the switches 5 and 6 are to be operated the foot must be repositioned by either raising it up over the reference member 8, or moving it fore or aft around the reference member to engage with the switches 5 and 6 so as to actuate the same for the right and left pivotal movement of the blade for example.

The angular positioning of the surface 2 is such as to make a comfortable support for the foot in operation and to enable it to readily manipulate the switches in the manner heretofore described, the angularity being such that the driver and operator can readily actuate said switches.

The switches in turn as indicated in FIG. 2 are provided with connections from the portions interiorally of the member or body 1 with suitable conduit such as 9 leading to an outlet of the box at 10 and to a cable 11 which in turn provides the connections with the usual power means for operating the snow plow blade such as an electric motor which in turn drives a hydraulic pump of known construction the hydraulic pump in turn actuating hydraulic piston cylinder instrumentalities to effect the various blade movements desired, all generally conventional and not here shown because they are well known.

Figure 3:
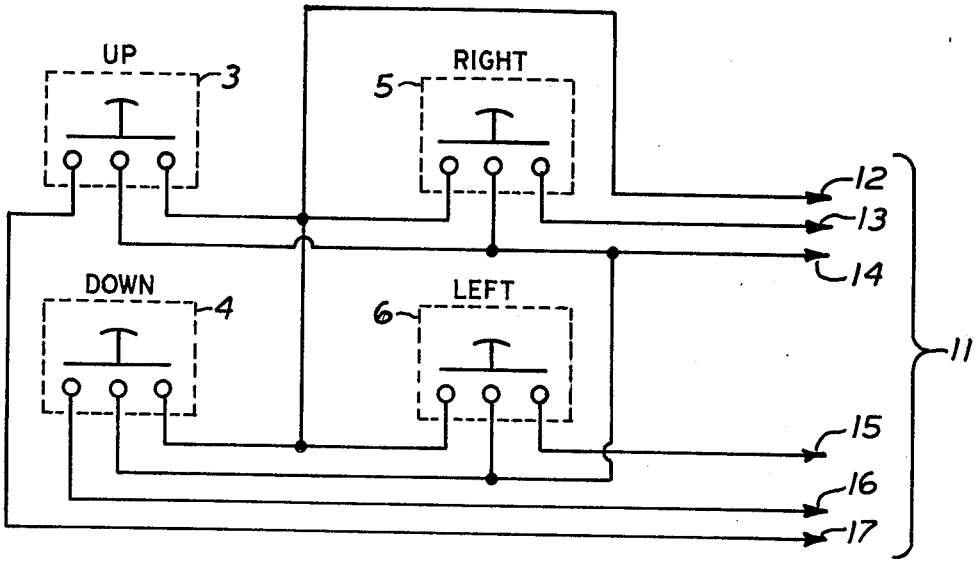

In order to provide the necessary action of connection and control of the electrical elements by the switches, it will be noted that FIG. 3 indicates a suitable circuit diagram wherein the switch for raising the blade designated 3 and the lowering of the blade by the switch 4 are provided with suitable connections leading both to a power source 12 and to the various portions of the electric drive indicated at 13 for opening a valve by suitable electrical means for angular rightward movement of the plow blade with the circuit branch 14 operating the pump which effects the necessary hydraulic drive, the line 15 opening the valve for angular movement of the blade to the left, 16 for opening the valve to lower the plow and 17 to open the valve for raising the plow, the switches for right and left pivotal movement of the plow being diagrammatically denoted and shown at 5 and 6.

The foregoing is a suitable wiring diagram, leading to conventionally provided valves and various other instrumentalities to effect the operation in accordance with known practice.

The invention herein before described and disclosed will be seen to provide a ready control for a snow plow or the like, preventing the operation of more than one switch at a time, which would be destructive of the various functions as a whole, the foot of the operator being availed of instead of the hand since one foot is not being used in any event in the operation of the vehicle certainly where automatic control is effected by an automatic transmission or some other means which does not require clutch operation.

I claim:

1. Foot control construction comprising a body having a first set of operating means spaced fore and aft for toe and heel operation respectively, a second set of like means similarly spaced, positioned adjacent the first set for like operation, said sets of operating means extendly upwardly an arch support element extending transversely between the first and second toe operating means and the first and second heel operating means, and a reference member extending upwardly relative to the body beyond said sets of operating means and located between the said sets of operating means to prevent the operation of both toe operating means simultaneously.

2. Foot control construction as claimed in claim 1, wherein the body includes an upper surface, the operating means having portions extending upwardly therefrom to be engaged by the toe and heel of an operator, the arch support element likewise extending upwardly above the surface to prevent simultaneous operation of the toe operating means when the heel operating means are being operated, and to prevent operation of the heel operating means, when the toe operating means are being operated.

3. Foot control construction as claimed in claim 1, wherein the body includes a substantially flat upper surface, the operating means comprise push button electric switches arranged in positions corresponding to the corners of a rectangle and extending above said surface, connections for said switches leading to power drive means, the arch support element comprises a ridge extending transversely between the switches at one end and those at the other end of such surface and of sufficient height to prevent operation of a toe switch when a heel switch is being operated.

4. Foot control construction as claimed in claim 3, wherein a reference member is provided in the form of a post extending outwardly from the ridge aforesaid, a distance to compel substantial re-positioning of the foot of an operator before the switches at opposite sides thereof are possible to operate.

5. Foot control construction as claimed in claim 3, wherein the flat upper surface is angularly positioned on the body to facilitate operation of the switches by the heel and toe.

* * * * *